United States Patent [19]

Kevin

[11] 4,026,449

[45] May 31, 1977

[54] APPARATUS AND METHOD FOR CARRYING ARTICLES ON A TENNIS RACQUET

[76] Inventor: Ernest W. Kevin, 2728 60th SE., Mercer Island, Wash. 98040

[22] Filed: Nov. 10, 1975

[21] Appl. No.: 630,358

[52] U.S. Cl. ..... 224/45 L; 211/14; 224/5 D

[51] Int. Cl.² ..... B65D 71/00

[58] Field of Search ..... 224/45 L, 5 D, 29 B, 224/42.46 R; 273/73, 74; 211/57, 14, 113

[56] References Cited

UNITED STATES PATENTS

| | | | |
|---|---|---|---|
| 366,030 | 7/1887 | Robinson | 211/113 |
| 2,088,980 | 8/1937 | Stein | 273/74 X |
| 2,109,799 | 1/1938 | Moore | 224/5 D X |
| 2,801,105 | 7/1957 | Action | 273/73 R |
| 2,932,514 | 4/1960 | Bergmark | 224/5 D X |
| 3,497,118 | 2/1970 | Najjar | 224/5 D |

FOREIGN PATENTS OR APPLICATIONS

| | | | |
|---|---|---|---|
| 864,220 | 1/1941 | France | 224/5 D |

*Primary Examiner*—L. J. Paperner
*Assistant Examiner*—Donald W. Underwood
*Attorney, Agent, or Firm*—Seed, Berry, Vernon & Baynham

[57] ABSTRACT

An apparatus and method for carrying articles, such as tennis balls and adapted to be removably attached to a tennis racquet. The articles are placed in a generally U-shaped trough having side walls which are resiliently biased toward each other to forcibly grip the article. A tongue extending from one transverse edge of the trough contains an aperture which receives the handle of the tennis racquet so that when the racquet is carried with the web or strings of the racquet extending downwardly, the tongue contacts the neck of the racquet with the trough extending along the racquet face. Friction increasing means, such as ridges, are provided along the inside surfaces of the trough to increase the friction between the article and the trough.

5 Claims, 5 Drawing Figures

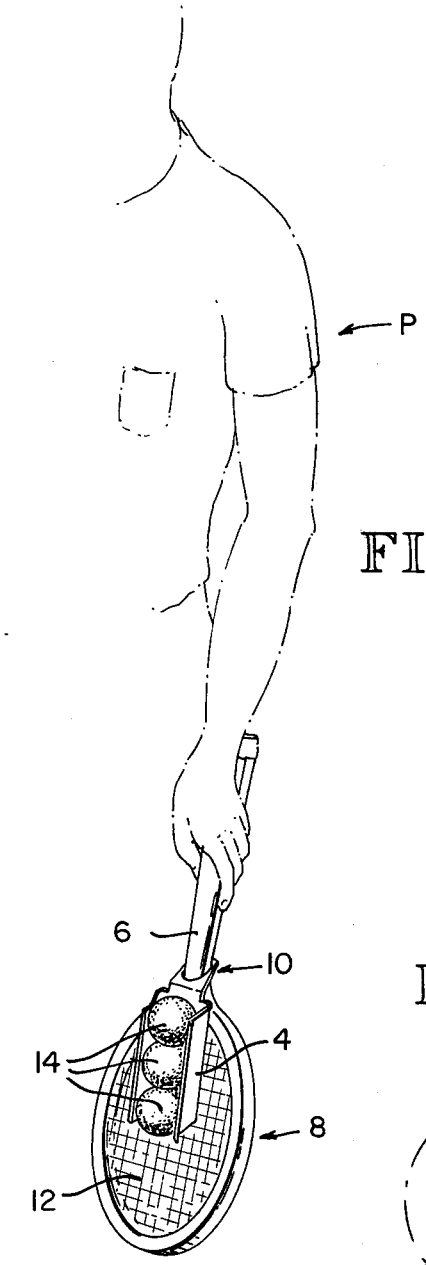
FIG. 1
FIG. 2
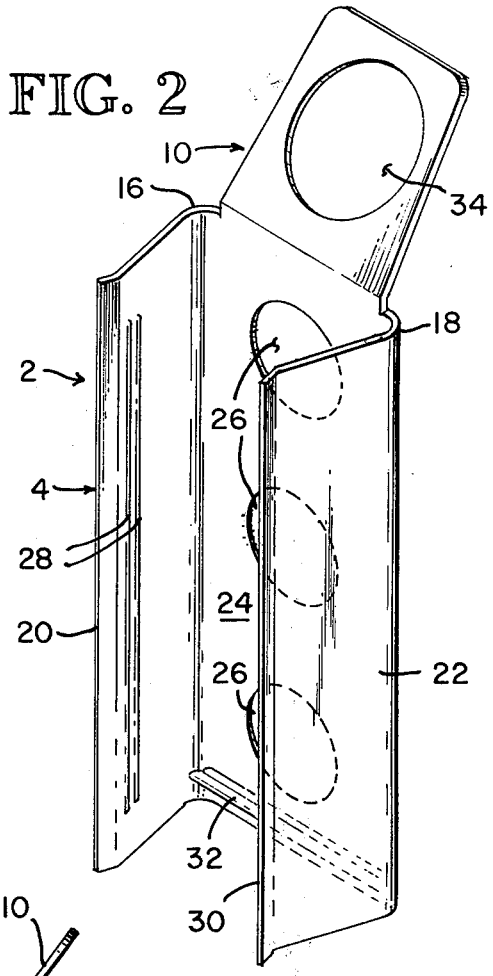
FIG. 3
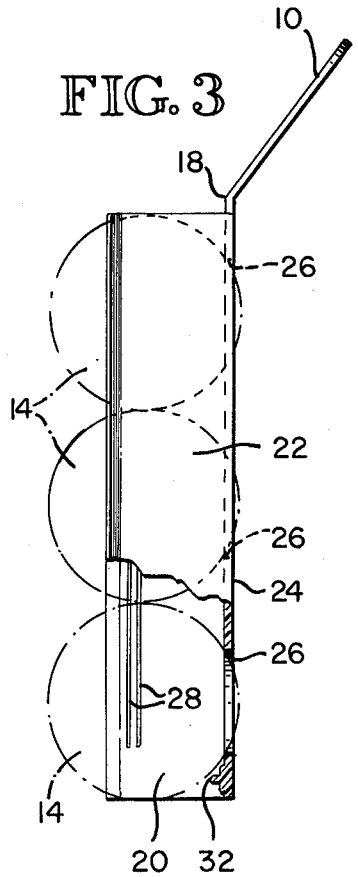
FIG. 4
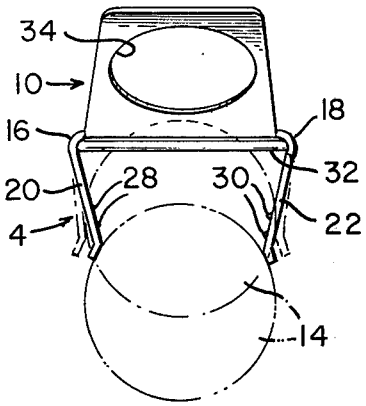
FIG. 5
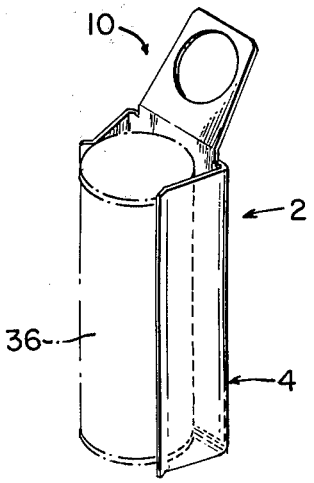

APPARATUS AND METHOD FOR CARRYING ARTICLES ON A TENNIS RACQUET

BACKGROUND OF THE INVENTION

1. Field of the Invention

This invention relates to an apparatus and method for transporting a wide variety of articles and, more particularly, to an apparatus and method for carrying the articles on a tennis racquet.

2. Description of the Prior Art

The game of tennis requires a tennis racquet and several tennis balls, all of which must be transported to a tennis court. Often, tennis players also carry other articles such as warm-up jackets and articles of refreshment. In the past, the tennis racquet, balls and other articles are individually carried allowing them to be inadvertently misplaced or dropped. Furthermore, it is often difficult for a tennis player to carry all of the articles which must be transported to the tennis court.

SUMMARY OF THE INVENTION

It is an object of the invention to provide an apparatus and method for carrying articles on a tennis racquet.

It is another object of the invention to provide an article-carrying apparatus which is easily and quickly fastened to and released from a tennis racquet.

It is still another object of the invention to provide an apparatus of the character described which securely holds a variety of articles.

These and other objects of the invention are provided by a generally U-shaped trough which is secured about the neck of the racquet by a tongue extending from a transverse edge of the trough and surrounding the racquet handle. The side walls of the trough may be resiliently biased toward each other so that the articles placed in the trough are forcibly gripped by the side walls. When the racquet is carried by the tennis player with the racquet extending downwardly, the trough extends from the neck of the racquet along the racquet's face.

BRIEF DESCRIPTION OF THE DRAWINGS

FIG. 1 is an isometic view showing the article-carrying apparatus secured to a tennis racquet and carried by a tennis player.

FIG. 2 is an isometric view of the article-transporting apparatus.

FIG. 3 is a cross sectional view taken along the line 3—3 of FIG. 2 showing a plurality of tennis balls in phantom.

FIG. 4 is a cross sectional view taken along the line 4—4 of FIG. 3 illustrating a tennis ball being inserted into the trough.

FIG. 5 is an isometric view of the article-carrying apparatus having a cylindrical can positioned within the trough.

DETAILED DESCRIPTION OF THE INVENTION

The article-carrying apparatus 2, as illustrated in FIG. 1, includes a generally U-shaped trough 4 which is secured around the handle 6 of a tennis racquet 8 by a tongue 10. When the racquet 8 is carried by the player P in a downwardly inclined position, the trough 4 extends from the neck of the racquet 8 along the face 12 thereof. The apparatus 2 is illustrated in FIG. 1 with three tennis balls 14 placed in the trough 4.

The structural details of the inventive article-carrying apparatus are best illustrated in FIGS. 2–4. The trough 4 may be formed by a sheet of resilient material containing two spaced aparts bends 16,18 of greater than 90° thereby forming trough side walls 20,22 which extend toward each other away from the trough floor 24. It is understood, however, the described structure may be manufactured by a wide variety of techniques, such as by molding and extruding, and it may be fabricated from a wide variety of materials, such as plastic and metal. The tongue 10 is an integrally formed extension of the trough floor 24 and extends from the floor at approximately 45°. The length of the trough 4 is illustrated in FIGS. 2–4 as being sufficient to accommodate three tennis balls, although longer or shorter troughs may be desired. The trough floor 24 contains a plurality of apertures 26 longitudinally spaced apart by approximately the diameter of a tennis ball so that part of the tennis balls 14 project through the floor 24 as best illustrated in FIGS. 3 and 4. The apertures 26 reduce the distance that tennis balls project above the trough 4 and prevent longitudinal movement of the tennis balls 14 with respect to the trough 4.

The inside surfaces of the trough 4 include a number of friction-increasing means to restrain inadvertent removal of articles from within the trough 4. Ridges 28,30 are placed along the longitudinal edges of the trough side walls 20,22 respectively, and a transverse ridge 32 is formed along the transverse edge of the trough floor 24 away from the tongue 10. The longitudinal edges of the side walls 20,22 are turned outwardly so that forces exerted on the side walls 20,22 by articles toward the floor 24 spread the side walls 20,22 apart to facilitate the placement of articles in the trough 4.

The tongue 10 which secures the trough 4 to the handle 6 of the tennis racquet 8 has formed therein an aperture 34 of sufficient size to accommodate the handle 6. The tongue is slipped over the end of the handle 6 and moved axially along the handle 6 until the tongue 10 contacts the neck of the racquet. Other forms of fastening means may also be used, however.

Although in most case the articles inserted into the trough will be tennis balls, the article-carrying apparatus 2 may also be used to carry other articles such as cylindrical containers or beverage bottles as illustrated in FIG. 5. Furthermore, although a resilient trough will generally be desired, any trough structure which is capable of frictionally engaging articles may be used.

The embodiment of the invention in which a particular property of privilege is claimed are defined as follows:

1. A device for carrying an article on a tennis racquet comprising:

a generally U-shaped trough including a pair of spaced apart walls extending from opposite sides of a floor, said trough having a length greater than twice the diameter of a tennis ball, an inside width at a point adjacent the free longitudinal edges of said trough being slightly less than the diameter of a tennis ball, and a height sufficient to accommodate the major portion of a tennis ball; and a retaining tongue extending from a lateral edge of said trough, said tongue including an aperture adapted to extend around and completely surround the handle of said racquet such that when said racquet is carried with the racquet extending downwardly said tongue rests on the neck of said racquet with said trough extending along the racquet face.

2. The device of claim 1, wherein said trough comprises a resilient sheet having a pair of spaced apart, longitudinal bends of greater than 90° interconnecting opposed trough walls and a floor such that said walls extend toward each other and are spaced apart less than the width of said floor.

3. A device for carrying an article on a tennis racquet comprising:

a generally U-shaped trough including a pair of spaced apart walls extending from opposite sides of a floor, said trough having a length greater than twice the diameter of a tennis ball, an inside width at a point adjacent the free longitudinal edges of said trough being slightly less than the diameter of a tennis ball, and a height sufficient to accommodate the major portion of a tennis ball, said trough further including a longitudinal ridge extending along the inside face of each of said walls adjacent the longitudinal edges thereof to increase the friction between said walls and a tennis ball positioned within said trough a retaining tongue extending from a lateral edge of said trough, said tongue including fastening means for securing said tongue to said tennis racquet.

4. The device of claim 3, wherein a ridge is formed adjacent a transverse edge of said trough floor to restrain longitudinal movement of a tennis ball with respect to said trough.

5. A method of transporting an article on a tennis racquet, comprising:

providing a generally U-shaped trough containing said article, said trough having walls which are resiliently biased toward each other so that said walls forcibly grip said article, said trough further having a tongue projecting from a transverse edge thereof, said tongue having an aperture adapted to extend around and completely surround the handle of said tennis racquet; and releasably securing said trough to the handle of said tennis racquet adjacent the neck thereof by inserting said handle through said aperture such that when said racquet is carried with the racquet extending downwardly one surface of said tongue contacts the neck of said racquet and said trough extends along the racquet face.

* * * * *